United States Patent [19]

Trumbach

[11] Patent Number: 5,031,702

[45] Date of Patent: Jul. 16, 1991

[54] FIRE EXTINGUISHING SYSTEM FOR A CHRISTMAS TREE

[76] Inventor: Bernard A. Trumbach, 1363 Cloverdale Ave., Los Angeles, Calif. 90019

[21] Appl. No.: 484,762

[22] Filed: Feb. 26, 1990

[51] Int. Cl.[5] ..... A62C 3/00

[52] U.S. Cl. ..... 169/61; 169/13; 169/14; 169/54; 169/56

[58] Field of Search ..... 169/13, 14, 26, 57, 169/60, 61, 33, 85, 66, 68; 248/511; 362/276, 121; 222/401

[56] References Cited

U.S. PATENT DOCUMENTS

| | | | |
|---|---|---|---|
| 3,171,493 | 3/1965 | Barr | 169/26 X |
| 3,888,438 | 6/1975 | Mizelle | 248/511 X |
| 4,113,020 | 9/1978 | Panetta | 169/26 |
| 4,813,487 | 3/1989 | Mikulec et al. | 169/57 X |
| 4,836,290 | 6/1989 | LeLande, Jr. | 169/13 X |

FOREIGN PATENT DOCUMENTS

| | | | |
|---|---|---|---|
| 0671819 | 7/1979 | U.S.S.R. | 169/61 |

*Primary Examiner*—Joseph F. Peters, Jr.
*Assistant Examiner*—Carla Mattix

[57] ABSTRACT

A fire extinguishing system for a Christmas tree including a base defining a water reservoir and having a submersible pump and container holding a fire extinguishing foam material mounted in the reservoir. A venturi block mixes the fire extinguishing foam material with water pumped from the reservoir upon detection of a fire condition by sensors scattered throughout the tree which mixture is discharged through a spray head mounted at the top of the tree. A relay connected to the fire sensors simultaneously closes an electric circuit to the pump and opens an electric circuit to the Christmas tree lights when the fire condition is sensed.

14 Claims, 2 Drawing Sheets

FIRE EXTINGUISHING SYSTEM FOR A CHRISTMAS TREE

BACKGROUND OF THE INVENTION

This invention relates to a fire protection device. More particularly, the invention relates to a fire extinguishing device for use with a Christmas tree.

It is known that Christmas trees and especially those comprised of a live tree present a fire hazard and devices for detecting a fire condition and either of both sounding an alarm and activating a fire extinguishing material into the tree exist. Some devices are deguised as tree ornaments, such as those disclosed in U.S. Pat. Nos. 4,113,020; 4,075,614; 4,623,878 and 4,709,763, however, these devices simply because of their limited size are limited to being strictly alarms such as a smoke detector or to holding and discharging relatively small quantities of fire extinguishing material which limits their effectiveness. One other effective fire extinguishing device is disclosed in U.S. Pat. No. 3,171,493 which incorporates a tank of pressurized fire extinguishing material which is ejected to a spray nozzle at the top of the tree upon fusing of a fusable element. While more effective than discreet ornament type devices, the larger exposed tank is esthetically undesirable. Further, it is always desirable to provide for extinguishing devices that provide increased fire extinguishing capability and efficiency which is the primary object of the present invention.

SUMMARY OF THE INVENTION

According to a preferred embodiment of the invention, there is provided an improved fire extinguishing device for use with a Christmas tree including a hollow base which functions as a stand for the tree and which forms a water reservoir.

A submersible pump is mounted in the resorvoir and connects to an external conduit adapted to extend through the tree to a spray head mounted at the top of the tree.

According to the preferred embodiment, a plurality of fire detection sensors are positionable within the tree at various locations which electrically connect to a relay for actuating the pump upon detection of a fire condition. Advantageously, water is pumped from the reservoir and sprayed downwardly into the tree.

According to a important feature of the invention, the electric circuit for the common Christmas tree lights is electrically connected to the relay for disconnection from the electric power supply upon detection of the fire condition.

According to another important feature of the invention, there is provided a container within the reservoir holding a fire extinguishing foam material for ejection, mixing and discharge with the water from the reservoir.

According to the invention, the fire extinguishing foam material is drawn into and mixed with the discharging water by way of a venturi block in the conduit leading from the pump outlet.

According to another embodiment of the invention, the submersible pump is replaced with a normally closed electrically operated solenoid valve having its inlet connectable to an essentially unlimited supply of pressurized water.

According to an important feature, the base is provided with a garden hose type connection for connection to a building water supply through a garden hose.

BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
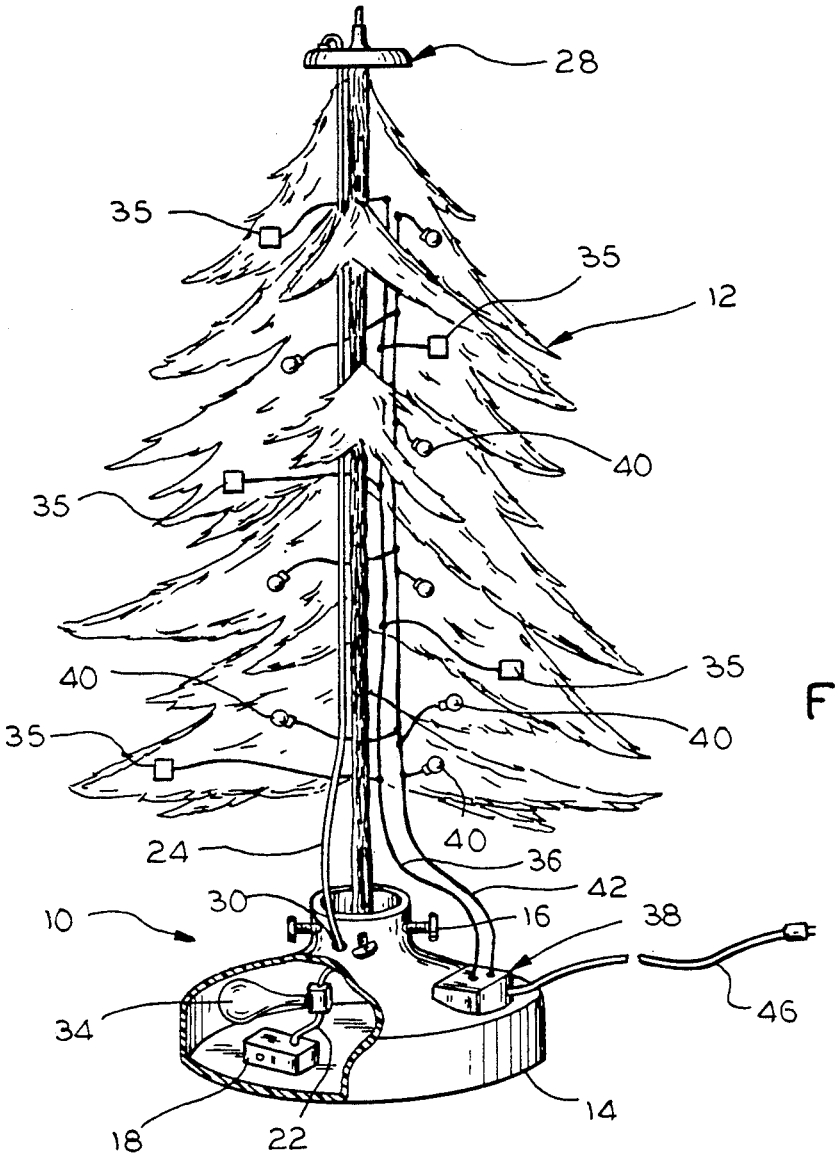
FIG. 1 is a pictorial view of a Christmas tree incorporating the fire extinguishing system according to the invention with a portion of the stand cut away showing details of construction.
Figure 2:
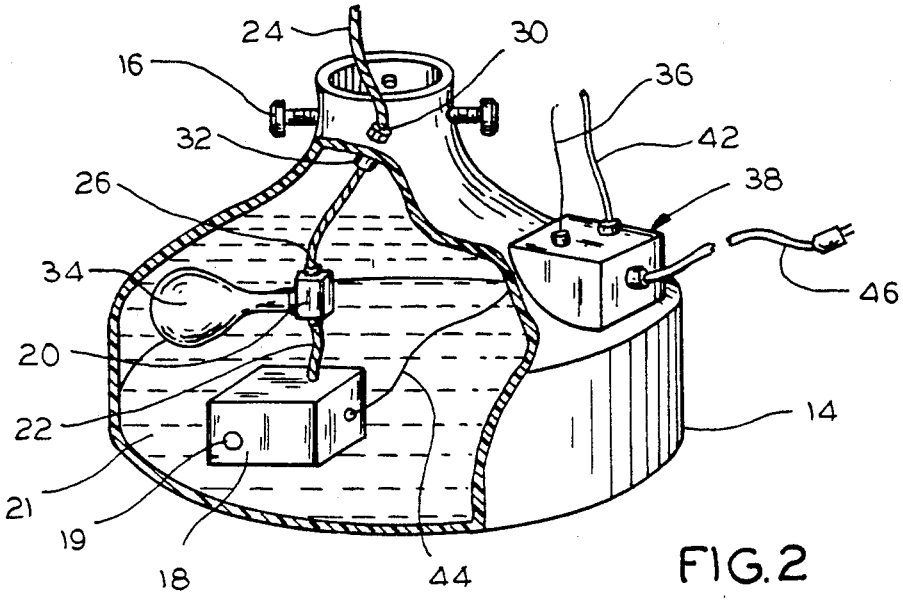
FIG. 2 is an enlarged view of the stand in FIG. 1 with a portion cut away showing further details of construction.

Shown in FIG. 1 is a fire extinguishing system for use with a Christmas tree according to the invention. The system includes a base 10 for holding a Christmas tree 12 in an upright position and which comprises a non-combustible hollow member 14 forming an internal reservoir for holding a volume of water 21 as shown in FIG. 2 and thumb screws 16 for engaging and holding the trunk of the tree. The stand is preferrably metallic but must be non-combustable and maybe painted, for example the color green, to be esthetically pleasing. Also, although not shown, the base 14 can be provided with additional legs or stabilizing members as desired. Preferrably, the base is sized to form a reservoir for holding a volume of water of between about 5 to 10 gallons.

As shown best in FIG. 2, a submersible pump 18 having an inlet 19 is mounted within the reservoir and connects to an external conduit 24 by way of piping 22, 26 and, in accordance with a preferred embodiment, a venturi block 20. The venturi block 20 has its low pressure inlet connected to a bulb or container 34 containing any well known fire extinguishing foam material. The fire extinguishing foam and venturi block 20 for extracting and mixing the foam with the water 21 being pumped to the conduit 24 is not a necessity but is preferred as adding an additional measure of fire extinguishing capability to the system. Venturi blocks 20, or ejectors as they are also referred to, for drawing one material into the stream of another material are well known and readily available and operate by connecting the material to be extracted, in the present case the fire extinguishing foam material in container 34, to the low pressure port or low pressure area of the venturi block. In operation, the fire extinguishing foam material will be drawn from the container 34 and intermixed with the water 21 and pumped to the external conduit 24.

Figure 4:
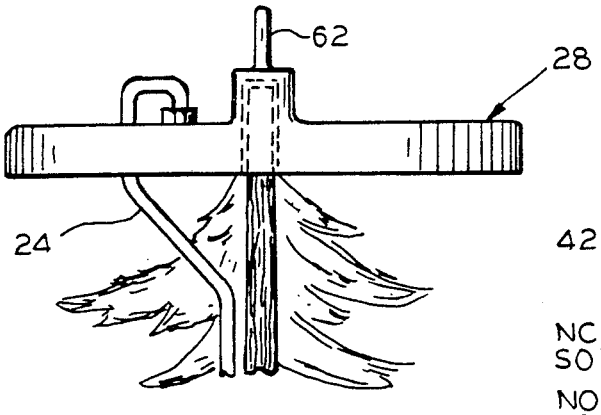
FIG. 4 is an enlarged view of a spray head for use with the invention shown mounted on the tree.

As shown in FIGS. 1 and 4, the external conduit 24 is also made of a non-combustible material and is adapted to extend upwardly to the top of the tree where it is connected to a spray head 28 for directing the water or water and fire extinguishing foam mixture downwardly into the tree.

Figure 5:
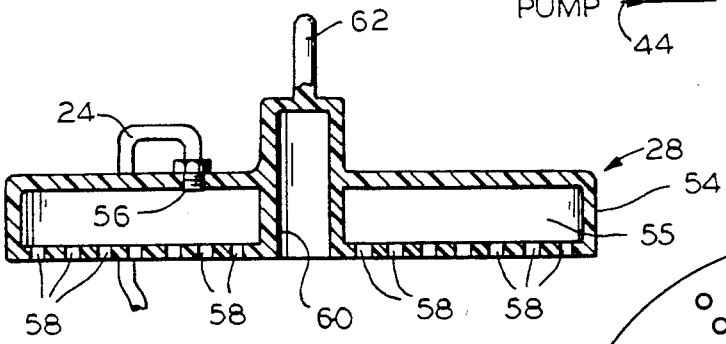
FIG. 5 is a vertical cross-sectional view through the spray head in FIG. 4 showing details of construction.
Figure 6:
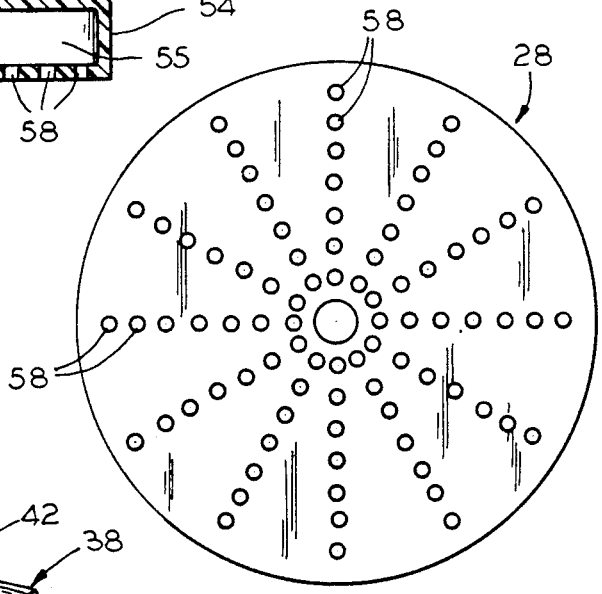
FIG. 6 is a bottom plan view of the spray head in FIG. 4 showing further details of construction.

Referring to FIGS. 5 and 6, the spray head 28 comprises a non-combustible hollow body 54 foaming a chamber 55 for receiving the fire extinguishing material from the conduit 24 through an inlet 56. A plurality of orfices or holes 58 are provided in the underside of the spray head from which the fire extinguishing material is sprayed.

As shown in FIGS. 4 and 5, the spray head is provided with a central blind hole 60 for receipt over an upper most vertically extending terminal branch or end of the tree trunk. If desired, a central vertical projection 62 can be provided on the spray head for assisting in attaching an upper ornament to the top of the tree which is typically done.

Means for actuating the submersible pump in response to a fire condition is provided in the form of a plurality of sensors 35 such as heat or smoke sensors scattered throughout the tree. The sensors 35 are connected by a lead 36 to an armature circuit 48 of a relay 38. The sensors in the embodiment shown are a type which maintain the armature circuit of the relay normally open but which close the circuit 48 upon detecting a fire condition. The pump 18 is connected by a lead 44 to a set of normally open contacts 52 of the relay which are caused to close upon actuation of the armature circuit 48 so as to connect the pump to the power supply 46.

Figure 3:
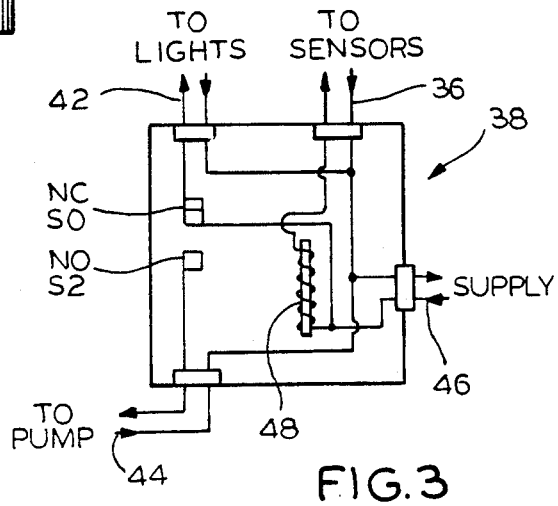
FIG. 3 is an electrical diagram of a relay circuit for use in the invention.

As shown in FIGS. 1, 2 and 3, means providing for protection against electrical fire within the lighting circuit 40 of the tree is provided by this invention. The lights 40 within the tree have their input lead 42 connected to a set of normally closed contacts 50 of the relay which are normally connected to the power supply 46 providing for normal activation of the lights. However, should a fire condition be detected by the sensors 35, the normally closed contacts will open when the armature 48 is activated thus disconnecting the power supply from the light circuit within the tree.

Figure 7:
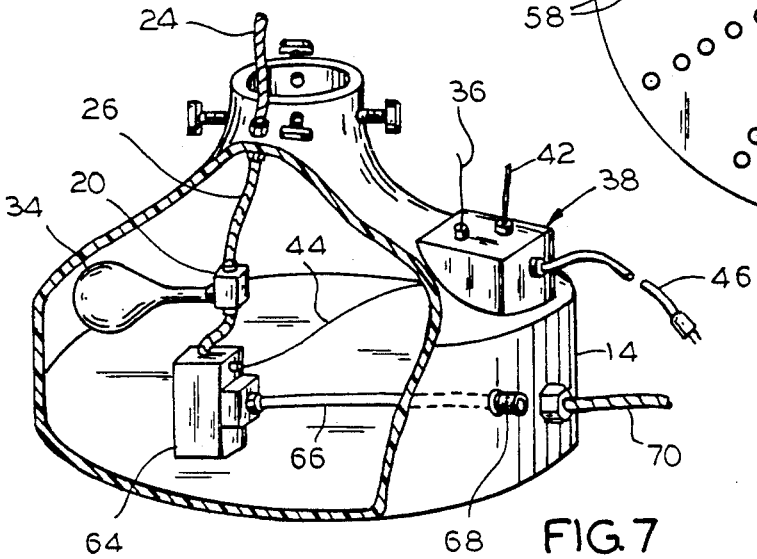
FIG. 7 is an enlarged view of an alternate embodiment of a stand according to the invention with a portion cut away showing details of construction.

Advantageously, it can seen that the system provides improved fire extinguishing capability over known existing systems however, recognizing that some Christmas trees can be very large and that the supply of water 21 and fire extinguishing foam material 34 is exhaustable, an alternative embodiment shown in FIG. 7 may be employed. This embodiment differs from that in FIGS. 1-6 only in that the submersible pump 19 is replaced by a normally closed electrically operated solenoid valve 64 and water inlet conduit 66 and associated garden hose type inlet connection 68 on the base 14 providing for connection to an external common garden hose 70. This system, it can be seen, provides for an esentially unlimited supply of water when the garden hose 70 is connected to a water supply of the building.

As with the preferred embodiment, the fire extinguishing foam containers 34 can be eliminated or added as desired but, in any case, continuous fire extinguishing capabilities are provided by the continuous unlimited water supply should the foam material be depleated before the fire is completely extinguished.

The system according to FIG. 7 is actuated in the same manner as that of FIGS. 1-6 in that the solenoid valve electric lead 44 is connected to the normally open contacts 52 of relay 38. Upon detection of a fire condition by the sensors 35, the relay closes the contacts to connect the solenoid valve to the power supply 46 and thus activate the valve to open and allow the pressurized water to flow from the hose 70 into the system.

Having described the preferred embodiment of the invention, those skilled in the art having the benefit of that description and the accompanying drawings can readily devise other embodiments and modifications and such other embodiments and modifications are to be considered to be within the scope of the appended claims.

What is claimed is:

1. A fire extinguishing system for a Christmas tree comprising:

a tree stand defining a water reservoir;

a submersible pump mounted in said reservoir;

a conduit connected to an outlet from said submersible pump, said conduit adapted to extend upwardly through said tree and having an outlet end proximate a top of said tree;

a spray head mounted to said outlet end of said conduit orientated for directing said water downwardly into said tree;

means for sensing a fire condition in said tree;

means responsive to said means for sensing said fire condition for actuating said submersible pump.

2. The fire extinguishing system as defined in claim 1 further including means for electrically disconnecting electric Christmas tree lights in said tree from a power source upon said means for sensing said fire condition.

3. The fire protection system as defined in claim 2 wherein said means for actuating said submersible pump is a relay coupled to a power supply, said submersible pump electrically connected to a pair of normally open contacts of said relay which are connected to said power supply and said means for sensing a fire condition electrically coupled to said relay to actuate said relay upon sensing said fire condition to close said normally open contacts whereby, said submersible pump is electrically connected to said power supply.

4. The fire extinguishing system as defined in claim 2 wherein said means for actuating said submersible pump and said means for electrically disconnecting said Christmas tree lights includes a relay, said relay connected to a power supply, said submersible pump electrically connected to normally open contacts of said relay, said Christmas tree lights electrically connected to normally closed contacts of said relay and said means for sensing electrically connected to said relay to actuate said relay to close said normally open contacts and to open said normally closed contacts upon sensing said fire condition.

5. The fire extinguishing system as defined in claim 1 further including a container in said reservoir including a fire extinguishing foam material and means for mixing said fire extinguishing foam material with said water for mutual discharge through said conduit upon actuation of said submersible pump.

6. The fire extinguishing system as defined in claim 5 wherein said means for mixing said fire extinguishing foam material with said water includes a venturi block in said conduit, said fire extinguishing foam material container connected to a low pressure inlet of said venturi block.

7. A fire extinguishing device for a Christmas tree comprising:

a tree stand including a water reservoir;

a submersible pump mounted in said reservoir;

a container including a fire extinguishing foam material mounted in said water reservoir;

a conduit connected to an outlet from said submersible pump, said conduit adapted to extend externally of said reservoir upwardly through said Christmas tree, said conduit having an outlet positionable near a top end of said tree;

a spray head connected to said conduit at the outlet from said conduit for directing a mixture of said water and said fire extinguishing foam material onto said Christmas tree;

means for mixing said fire extinguishing foam material with said water for mutual discharge through said conduit to said spray head;

means for sensing a fire condition in said tree; and means responsive to said means for sensing for actuating said submersible pump.

8. The fire extinguishing device as defined in claim 7 wherein said means for actuating said submersible pump includes a relay, said submersible pump electrically connected across normally open contacts of said relay connected across a power supply input to said relay, said means for sensing electrically connected to actuate said relay to close said normally open contacts upon sensing said fire condition.

9. The fire extinguishing system as defined in claim 8 wherein said relay further includes normally closed contacts connected across said power supply input to said relay, a set of Christmas tree lights being connectable across said normally closed contacts, said relay actuable by said means for sensing a fire condition to open said normally closed contacts.

10. A fire extinguishing system for a Christmas tree comprising:

a hollow base including means for holding said Christmas tree upright;

a normally closed solenoid valve mounted in said hollow base, said solenoid valve including an inlet and an outlet;

means for connecting an external garden hose to said inlet of said solenoid valve;

a conduit connected to said outlet from said solenoid valve adapted to extend externally of said base upwardly through said Christmas tree, said conduit including a spray head at an upper end orientated for directing a fire extinguishing material downwardly into said Christmas tree;

means for sensing a fire condition in said Christmas tree;

means responsive to said means for sensing for opening said normally closed solenoid valve.

11. The fire extinguishing system as defined in claim 10 wherein said means responsive to said means for sensing said fire condition is adapted to further electrically disconnect a Christmas tree light circuit from a power supply.

12. The fire extinguishing system as defined in claim 11 wherein said means responsive to said means for sensing is a relay, said solenoid valve electrically connected across normally open contacts of said relay, said Christmas tree electric light circuit electrically connected across normally closed contacts of said relay.

13. The fire extinguishing system as defined in claim 10 further including a container in said hollow base including a fire extinguishing foam material and means for mixing said fire extinguishing foam material with water introduced into said conduit upon opening of said solenoid valve.

14. The fire extinguishing system as defined in claim 12 further including a container in said hollow base including a fire extinguishing foam material and means for mixing said fire extinguishing foam material with water introduced into said conduit upon opening of said solenoid valve.

* * * * *